US005685023A

United States Patent [19]

Alston

[11] Patent Number: 5,685,023

[45] Date of Patent: Nov. 11, 1997

[54] CHILD COMMODE SEAT

[76] Inventor: William D. Alston, 321 S. Brent St., Ventura, Calif. 93003

[21] Appl. No.: 690,842

[22] Filed: Aug. 1, 1996

[51] Int. Cl.[6] ..... A47K 13/06

[52] U.S. Cl. ..... 4/239

[58] Field of Search ..... 4/235, 236, 239, 4/240

[56] References Cited

U.S. PATENT DOCUMENTS

| | | | |
|---|---|---|---|
| 1,196,427 | 8/1916 | Brandenburg . | |
| 1,513,408 | 10/1924 | McCandless | 4/239 |
| 1,701,115 | 2/1929 | McKinney, Jr. . | |
| 2,545,598 | 3/1951 | Barnes | 4/239 |
| 2,808,874 | 10/1957 | Liebling | 155/131 |
| 3,205,510 | 9/1965 | Levine | 4/234 |
| 3,590,402 | 7/1971 | Penley | 4/239 |
| 4,516,279 | 5/1985 | Block | 4/235 |
| 5,182,818 | 2/1993 | Nawoj | 4/235 |
| 5,363,509 | 11/1994 | Evans | 4/235 |
| 5,384,917 | 1/1995 | Epling | 4/235 |

*Primary Examiner*—Charles E. Phillips
*Attorney, Agent, or Firm*—Jack C. Munro

[57] ABSTRACT

A child commode seat is to be used in combination with a conventional toilet seat that is to decrease the dimension of the opening within the conventional toilet seat that is to be of a size to permit usage by children. The child commode seat comprises an annular ring shaped member to which is integrally secured and protrudes laterally therefrom a thin, narrow strip of a plastic material. This thin, narrow strip is to be bent over in a deflect configuration with the outer end of the strip to be located directly adjacent the undersurface of the seat. An adhesive pad is to secure the outer end to the undersurface. A biasing action is created by the thin, narrow strip that is not sufficient to lift the annular ring shaped member from the seat, but is sufficient to hold the annular ring shaped member in an upright position when it is manually moved to the upright position which is located substantially ninety degrees from the position directly adjacent the seat.

3 Claims, 1 Drawing Sheet

CHILD COMMODE SEAT

BACKGROUND OF THE INVENTION

1) Field of the Invention

The field of this invention relates to commodes, which are commonly known as toilets, and more particularly to a new, improved child commode seat which is to be utilized in conjunction with a conventional toilet for the accommodation and toilet training of small children.

2) Description of the Prior Art

The conventional toilet is designed for use by adults. Children, being smaller in size, normally find it difficult to use such toilets due to the fact that such toilets are much too large. The large size of the conventional toilet is difficult for a child to use when training of the child. Therefore, it is almost mandatory that some form of a child commode seat be used with a conventional toilet seat so that the child can easily use the toilet.

In the past, a number of child commode seats have been constructed. However, these devices typically have been construction and therefore are not easily installable in conjunction with the toilet, and require an elevated manufacturing cost which usually is passed on to the consumer. As a result, such complex children toilet seats have not experienced widespread usage.

SUMMARY OF THE INVENTION

The principal objective of the present invention is to construct a child commode seat that is to be usable for children, is of simple construction, and can be quickly and easily installed on the conventional toilet seat by even the most unskilled individual.

Another objective of the present invention is to construct a child commode seat that can be installed in conjunction with a conventional toilet seat which permits usage of the toilet by both adults and children.

Another objective of the present invention is to construct a child commode seat which is to be movable from a down position located directly against the conventional toilet seat to an upright position which is located directly adjacent the toilet tank, and when in the upright position the child commode seat incurs a force tending to maintain the child commode seat in the upright position.

Another objective of the present invention is to construct a child commode seat as an integral, one-piece unit not requiring manufacturing of several parts.

Another objective of the present invention is to construct a child commode seat which facilitates in-place cleaning.

The child commode seat of the present invention is constructed of an annular ring shaped member which is formed of a plastic material. The annular shaped member has a thin strip of material integrally connected to the annular member and protruding laterally from the exterior side edge of the annular shaped member. The strip of material includes an adhesive pad mounted on the undersurface of the strip. The strip is to be bent over upon itself with the adhesive pad to be secured to the undersurface of the seat that is mounted on the rim of a conventional toilet. The deflection of the strip inherently produces a biasing action that is applied to the annular ring shaped member tending to lift the annular ring shaped member off the conventional seat. However, the force of the biasing action is insufficient to raise the annular ring shaped member off the conventional toilet seat when the conventional toilet seat is located against the rim of the bowl of the toilet. However, if the annular ring shaped member is lifted to an upright position which is located directly adjacent the tank of the toilet and which is also about ninety degrees from the position located against the conventional toilet seat, this force will be sufficient to maintain the annular ring shaped member in this upright position.

DETAILED DESCRIPTION OF THE PREFERRED EMBODIMENT

Figure 1:
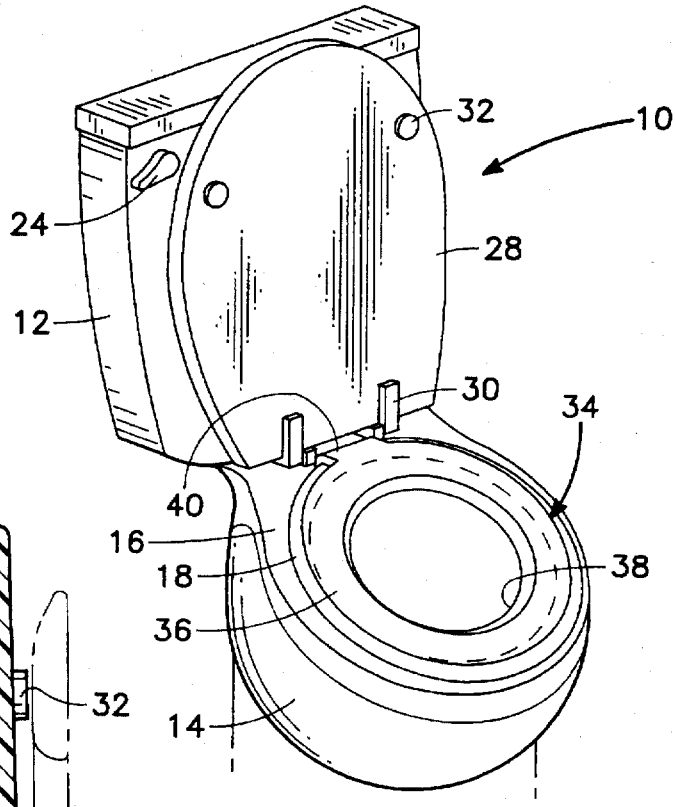
FIG. 1 is an isometric view of a conventional toilet and conventional toilet seat and cover on which is mounted the child commode seat of the present invention.
Figure 2:
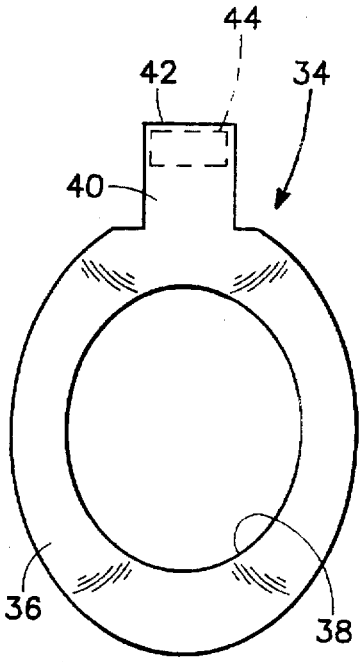
FIG. 2 is a top plan view of the child commode seat of the present invention.

Referring particularly to the drawing, there is shown in FIG. 1 a conventional toilet 10 which comprises a bowl 14 which has an upper surface in the form of a planer rim 16. Mounted on the back side of the planer rim 16 is a toilet tank 12. A flush valve 24 is mounted on the toilet tank 12. A ring shaped seat 18 is mounted on a hinge 22. This hinge 22 is then fixedly mounted on the planer rim 16. Ring shaped seat 18 includes shock absorbing pads 26 which are to rest on a portion of the planer rim 16. The ring shaped seat 18 includes an enlarged center opening 20. The ring shaped seat 18 is placed on the planer rim 16 so the enlarged center opening 20 will connect with the internal chamber of the bowl 14. The ring shaped seat 18 has an undersurface 19 and an upper surface 21. The undersurface 19 is located directly adjacent the planer rim 16. The upper surface 21 is to be directly contacted by an adult when using of the ring shaped seat 18. The ring shaped seat 18 is to be used when in the position shown in the drawing in FIGS. 1 and 3.

A bracket 30 is connected to the hinge 22. Fixedly mounted to the bracket 30 is a cover 28. It is the function of the cover 28 to be located against the upper surface 21 of the ring shaped seat 18 during the time the ring shaped seat 18 is not being used. The cover 28 is to be located in a vertical or upright position directly adjacent the toilet tank 12, as is also shown in the drawing, during the time that the ring shaped seat 18 is being used. Mounted on the undersurface of cover 28 are a pair of shock absorbing pads 32 which are to come into direct contact with the upper surface 21 of the ring shaped seat 18.

The child commode seat 34 of this invention is formed of an annular ring shaped member 36 which has an enlarged center opening 38. The size of the enlarged center opening 38 is less than the enlarged center opening 20. The size of the enlarged center opening 38 is designed to provide a resting surface for the buttocks of a small child where normally the size of the buttocks of a small child would have a tendency to fall through enlarged center opening 20. The annular ring shaped member 36 includes a side edge from which laterally extends a strip 40. The strip 40 is integral with the annular ring shaped member 36 and more than likely the strip 40 will be constructed of a polyethylene plastic. Strip 40 is to be bendable so that it can be deflected so the outer end 42 of the strip 40 can be located directly adjacent the undersurface 19 of the ring shaped seat 18. The strip 40 also passes directly adjacent the hinge 22. An adhesive pad 44 is mounted on the strip 40 with this adhesive pad 44 to provide the securement of the outer end 42 to the undersurface 19 of the ring shaped seat 18.

The installation of the child commode seat 34 of this invention is exceedingly simple. It is only necessary that the adhesive pad 44 be exposed and then the outer end 42 of the strip 40 be inserted through the gap area 23 that is provided between the hinge 22 and the ring shaped seat 18. The adhesive pad 44 is then pressed tightly against the undersurface 19 while making sure that the child commode seat 34 centrally aligns with the ring shaped seat 18. There is produced, because of the bending of the strip 40, a biasing force that will tend to lift the annular ring shaped member 36 off the ring shaped seat 18. However, when the annular ring shaped member 36 is in the down position as shown in the solid lines of FIG. 3 or as is shown in FIG. 1, this force is insufficient to lift the child commode seat 34 off of the ring shaped seat 18. This means that the child commode seat 34 will remain connected with the ring shaped seat 18 during usage by the child. However, when it is necessary for the toilet 10 to be utilized by an adult, the adult only needs to physically pick up the annular ring shaped member 36 and lift such to the upright position which is shown in dotted lines in FIG. 3 of the drawing. The dotted line position which shows the annular ring shaped member 36 located directly adjacent the cover 28 is defined as the upright position. The force of the deflected strip 40 tends to hold the annular ring shaped member 36 directly against the shock absorbing pad 32 of the cover 28.

Figure 3:
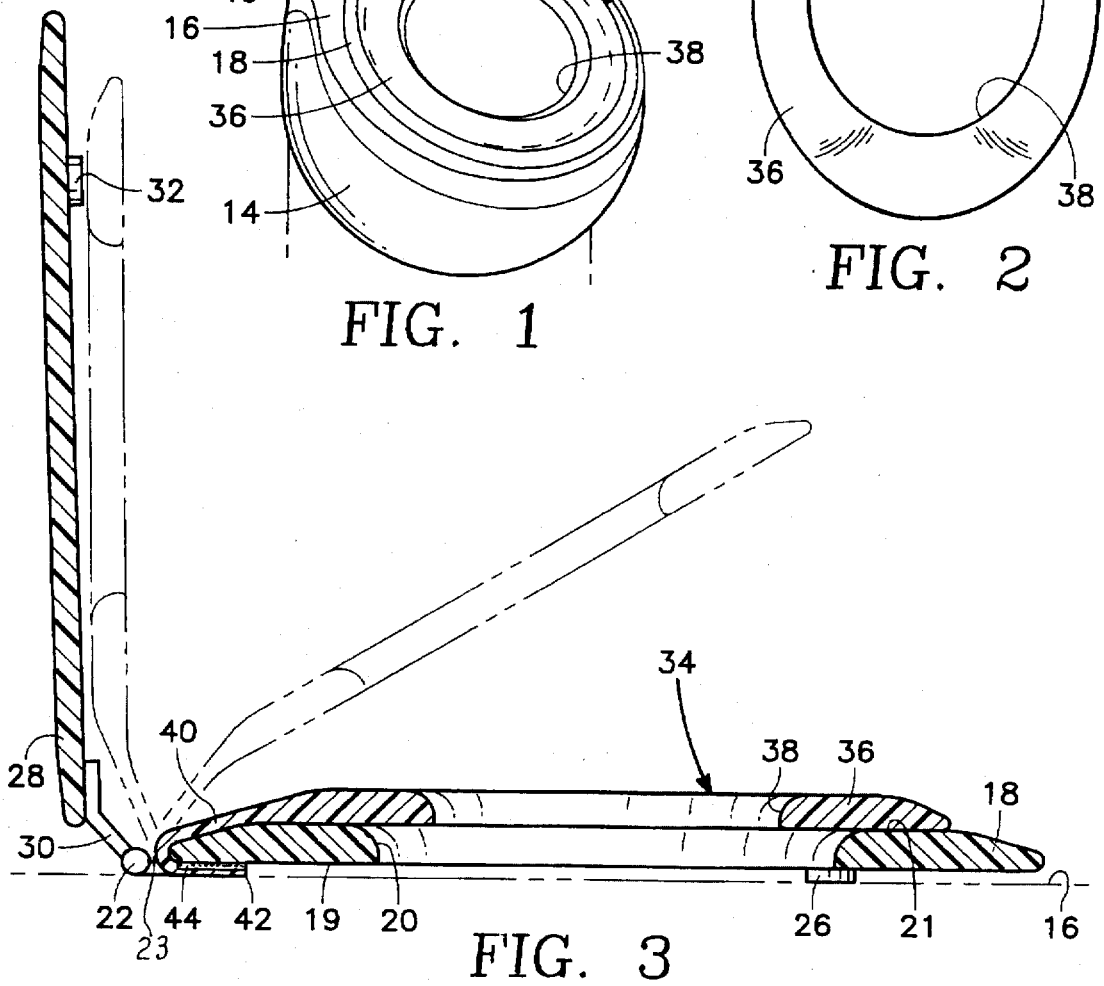
FIG. 3 is a transverse cross-sectional view through the conventional toilet seat cover mounted on the toilet of FIG. 1 showing the mounting of the child commode seat in conjunction with the conventional toilet seat.

Referring particularly to FIG. 3, there is shown in dotted lines a position of the annular ring shaped member 36 in between the down position and the upright position. This intermediate position would be the position where the force would be essentially balanced.

What is claimed is:

1. In combination with a conventional toilet, said toilet having a bowl, said bowl having a rim, a seat formed in a ring shape enclosing a first opening, said seat being mounted on said rim, said seat having an undersurface located directly adjacent said rim and an upper surface upon which it is adapted that a human sit, a child commode seat comprising:

an annular ring shaped member having a second opening, said opening being smaller in size than said first opening, said annular ring shaped member being movable between a down position located on said seat to an upright position forming substantially a ninety degree angle relative to said seat; and a thin, narrow strip integral with said annular ring shaped member, said strip having an outer end, securement means attached to said outer end, said strip being deflected into a bent-over-upon-itself configuration with said outer end being located against said undersurface, said securement means for securely mounting said strip onto said undersurface of said seat, a biasing action is produced by said strip being deflected which tends to lift said annular shaped member and which will function to maintain said annular ring shaped member in said upright position when located in said upright position, said biasing action not being sufficient to lift said annular ring shaped member when in said down position.

2. The combination as defined in claim 1 wherein:

said securement means comprising an adhesive pad.

3. The combination as defined in claim 2 wherein:

said thin, narrow strip being formed of a plastic material.

* * * * *